US006745652B2

(12) United States Patent
Chen

(10) Patent No.: US 6,745,652 B2
(45) Date of Patent: Jun. 8, 2004

(54) TOOL COMBINING ROD

(76) Inventor: Ho-Tien Chen, P. O. Box 2-10, Tainan City (TW)

( * ) Notice: Subject to any disclaimer, the term of this patent is extended or adjusted under 35 U.S.C. 154(b) by 0 days.

(21) Appl. No.: 10/213,994

(22) Filed: Aug. 2, 2002

(65) Prior Publication Data

US 2004/0020335 A1 Feb. 5, 2004

(51) Int. Cl.[7] ..... B25B 23/00
(52) U.S. Cl. ..... 81/438; 81/177.85
(58) Field of Search ..... 81/438, 437, 177.2, 81/177.85, 176.15, 491, 442–445

(56) References Cited

U.S. PATENT DOCUMENTS

| | | | | | |
|---|---|---|---|---|---|
| 299,428 | A | * | 5/1884 | Small | 81/491 |
| 3,121,572 | A | * | 2/1964 | Torok | 279/50 |
| 3,753,455 | A | * | 8/1973 | Butler | 81/439 |
| 3,935,762 | A | * | 2/1976 | Tudisco | 81/177.85 |
| 4,404,874 | A | * | 9/1983 | Lieser | 81/438 |
| 4,581,962 | A | * | 4/1986 | Marbourg | 81/451 |
| 4,651,596 | A | * | 3/1987 | Rachanski | 81/53.2 |
| 4,960,015 | A | * | 10/1990 | Mathews | 81/177.2 |
| 5,469,679 | A | * | 11/1995 | Burkard et al. | 52/301 |
| 5,867,912 | A | * | 2/1999 | Hickok et al. | 30/329 |
| 5,938,212 | A | * | 8/1999 | Wadsworth | 279/42 |
| 6,112,623 | A | * | 9/2000 | Bigand et al. | 81/59.1 |
| 6,138,530 | A | * | 10/2000 | McClure | 81/58 |
| 6,282,999 | B1 | * | 9/2001 | Hite et al. | 81/445 |
| 6,401,573 | B2 | * | 6/2002 | McClure | 81/58 |

* cited by examiner

*Primary Examiner*—Lee D. Wilson
*Assistant Examiner*—David B. Thomas

(57) ABSTRACT

A tool combining rod includes a rod member, an engaging head member and an engage member. The rod member has a rear non-circular portion for combining with a driving tool, and a front combining hollow for combining with the engage head member and the engage member. The engage member has a center hole for the engage head member to fit through therein and an elastic annular wall to tightly fit in the combining hole of the rod member. The engage member has a larger diameter than or equal to the outer diameter of the rod member, and the outer diameter of the front combining hollow portion is smaller than or equal to that of the rear non-circular portion to convenience of combining with a screwdriver.

6 Claims, 13 Drawing Sheets

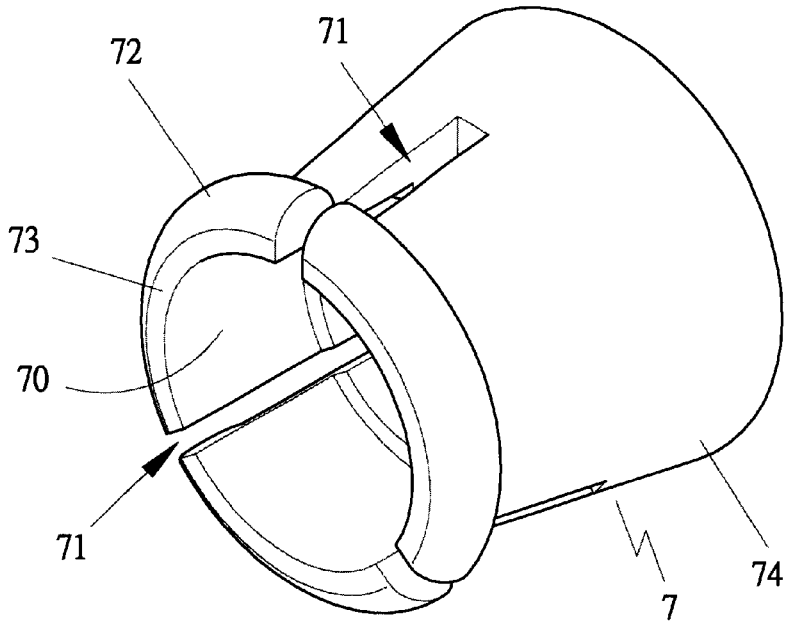
FIG 13
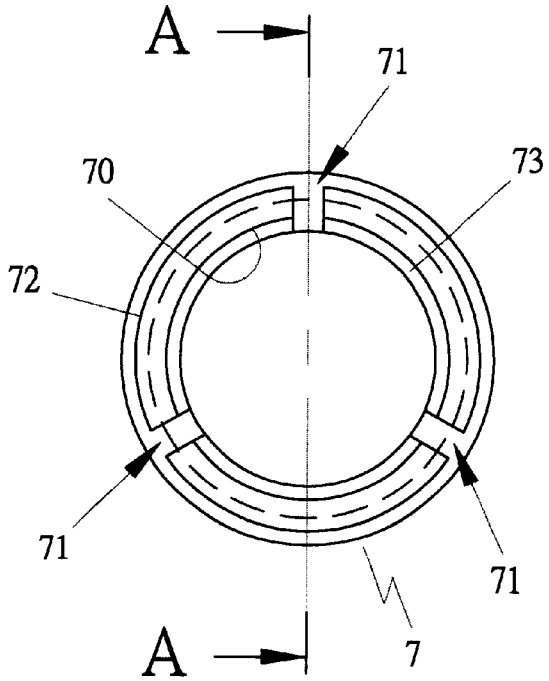
FIG 14
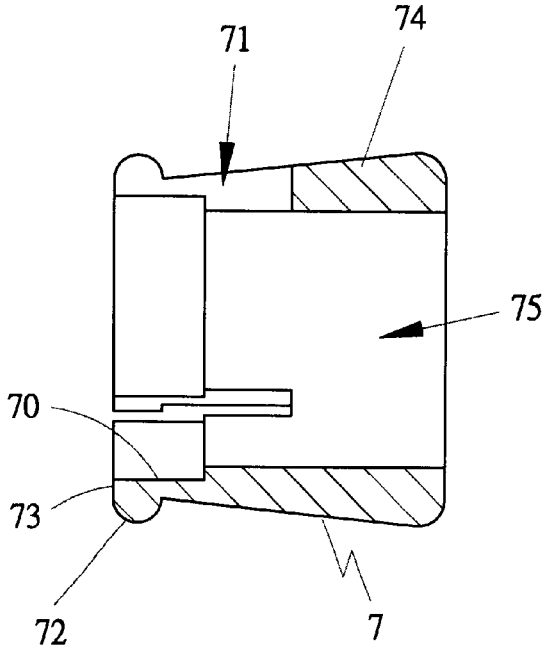
FIG 15 (A-A)

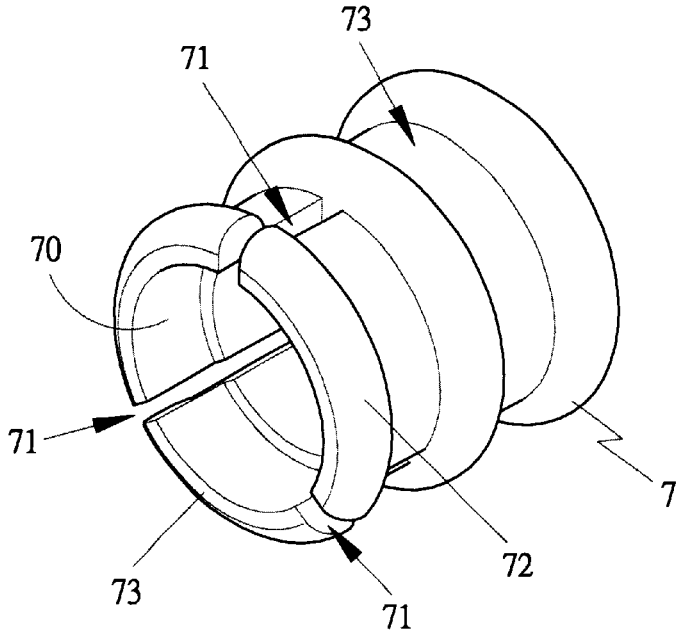
FIG 16
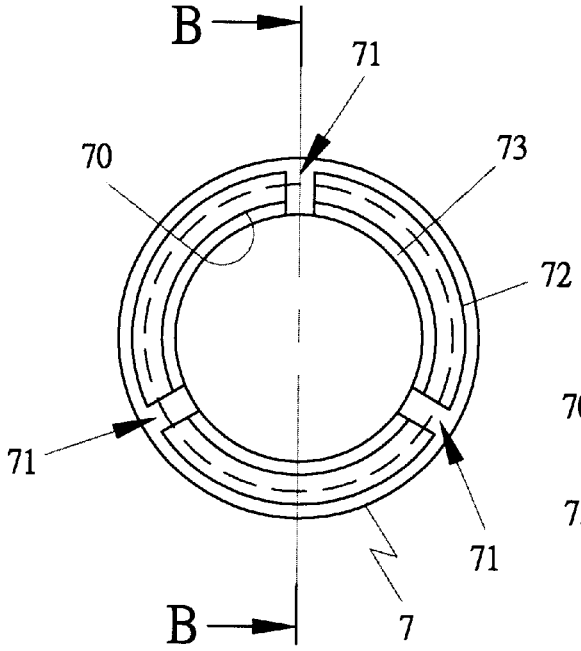
FIG 17
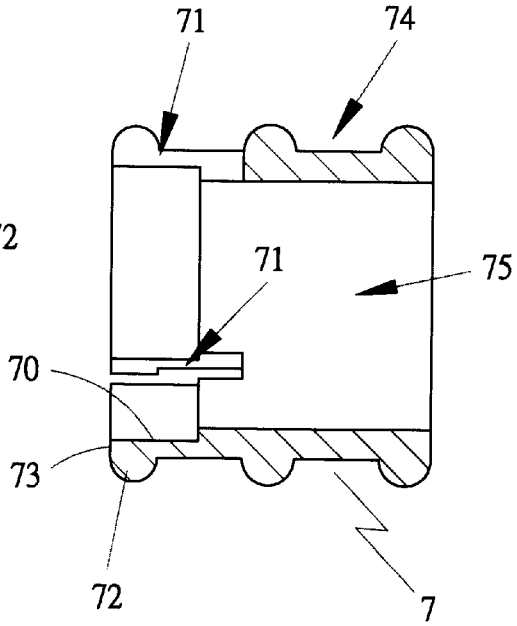
FIG 18 (B-B)

TOOL COMBINING ROD

BACKGROUND OF THE INVENTION

This invention relates to a tool combining rod, particularly to one able to fix the engaging head member of quickly and firmly, with the engaging head member possible to be lengthened and applicable to an automatic, screwdriver.

Conventional tool combining rods are almost the same in structure. One conventional tool combining rod shown in FIGS. 1, 2 and 3 includes a rod member 1 and an engaging head member 2. The rod member 1 is bored at the front end with a combining hollow 10 have the same shape as that of the rod portion 20 of the engaging head member 2 so as to let them combined together closely. The combining hollow 10 is bored with one or two bead holes 12 in its wall 11 for receiving a bead 13, which is pressed by a sleeve 14, as shown in FIGS. 1 and 2. Or the combining hollow 10 may have its wall 11 bored with a C-shaped groove 12A for a C-shaped clasp 13A to be fitted therein, as shown in FIG. 3. Further, between the engage hole 12 and the engage bead 13 or between the C-shaped groove 12A and the C-shaped clasp 13A there must be a space and a little elasticity for the engage bead 13 and the C-shaped clasp 13A to move around in order to permit the engaging head member 2 to be pulled out for replacing and inserted in place with easiness.

A fourth conventional tool combining rod, as shown in FIG. 4, includes a rod member 1 provided with a combining hollow 10 having a hole 15 in the rear side, and a C-shaped groove 12A in its wall for receiving a C-shaped clasp 16. Thus, in case the engaging head member 2 has to be pulled out or replaced, an auxiliary tool 3 has to be inserted in the hole 15 and pushed the bottom of the engaging head member 2 outward so as to take out or replace the engaging head member 2.

However, each of the four conventional tool combining rods described above needs to be provided with a bead hole 13 or an annular groove 21 in the rod portion 20 of the engaging head member 2 not only to let the engaging head member 2 fixed in position by the bead(s) 13 or the C-shaped clasps 13A, 16, but also enable the bead(s) 13 or the C-shaped clasp 13A, 16 to move respectively in the bead hole 12 or in the C-shaped groove 12A, thus letting the engaging head member 2 and the combining hollow 10 combined together or disengaged from each other smoothly and easily.

In view of the above-mentioned condition, the thickness L of the hollow wall 11 has to be set within a proper range. The conventional tool combining rods shown in FIGS. 1, 2 and 3 all have too large an outer diameter (over 7 mm) so they are not applicable to an automatic screwdriver 4 fitted with a screw band, but only available for a common tool having a comparatively short combining rod. The fourth conventional tool combining rod shown in FIG. 4 has the outer diameter of its rod member 1 diminished to conform to the foresaid automatic screwdriver. Under this condition, after the engaging head member 2 is combined with the combining hollow 10 of the rod member 1, the engaging head member 2 is closely stuck by the C-shaped clasp 16 in such a condition that it can hardly be pulled out by hand, and so the rod member 1 has to be bored with the side hole 15 for an auxiliary tool 3 to insert therein and prop out the engaging head member 2 by means of an auxiliary tool. However, the side hole 15 bored in the wall of the rod member 1 will reduce the strength of the rod member 1, possible to render the tool combining rod 1 twisted, deformed and broken off at the location of the side hole 15 in the event of the twisting force of combination being too large.

Still the fifth conventional tool combining rod shown in FIG. 5, includes a rod portion 1 having a combining hollow 10 in the front end. The combining hollow 10 has its annular wall 11 bored with a bead hole 12 for receiving a bead 13. A contractible spring 14 is provided on the outer side of the hollow wall 11 of the combining hollow 10, having one end pushing against the annular surface 111 of the hollow wall 11 and the other end pushing against the inner annular surface 140 of a slide sleeve 14A, and positioned between the slide sleeve 14A and the hollow wall 11 of the combining hollow 10. Besides, the combining hollow 10 has its wall provided annularly with a C-shaped clasp 112 to prevent the slide sleeve 14A from slipping off. The slide sleeve 14A has its front end formed with an inner sloping annular edge 141 so as to let the combination of the bead(s) 13 with the engaging head member 2 able to be loosened for facilitating removing or replacing the engaging head member 2.

As described above, the fifth conventional tool combining rod shown in FIG. 5 has a slide sleeve 14A provided on the rod member 1 for replacing the engaging head member 2 easily, but the outer diameter d1 of the slide sleeve 14A is much larger than the outer diameter d2 of the rod member 1. As a result, such a tool combining rod provided with two combining components is not applicable to an automatic screwdriver 4. In operating, the automatic screwdriver 4 used at the present usually has a screw screwed out and then screwed into an objective, and the automatic screwdriver unit 42 may recover its original position by the recovering resilience of the contractible spring 14. At this time, the outer annular wall of the tool combining rod is positioned in a screw bend hole 401 and wrapped by the annular wall of a screw hole 402. If the tool combining rod is too large, it is hard for the automatic screwdriver tool unit 42 to recover its original position, failing to operate smoothly.

Therefore, the tool combining rod employed today has a small outer diameter and is made integral as one 1C, as shown in FIGS. 6, 7 and 8, but this integrally made tool combining rod 1C may become unusable and has to be replaced or cast away in case the engage portion 22 of its engaging head member 2 is worn off, increasing cost in using.

SUMMARY OF THE INVENTION

This invention is devised to offer a tool combining rod having a small outer diameter (less than 7 mm) and applicable to an automatic screwdriver, able to be operated smoothly and lower cost in manufacturing.

The present invention has the following features.

1. The tool combining rod consists of a rod member having one end formed with a non-round and equiangular portion to be combined with a drive tool for transmitting power, and the other end provided with a combining hollow and having an outer diameter smaller than or equal to the largest outer diameter of foresaid non-round surface, with the combining hollow provided with an inner annular surface for facilitating receiving an engage member.

2. The engage member is bored with a central hole for receiving the rod portion of the engaging head member, and provided with an elastic annular surface for combining with the inner annular surface of the combining hollow of the rod member and firmly holding the engaging head member to prevent it from slipping off.

3. The tool combining rod is composed of a rod member, an engaging head member and an engage member, therefore in case the engaging head member is worn off due to driving screws, it needs only to replace the engaging head member, reducing expenditure of a user.

BRIEF DESCRIPTION OF DRAWINGS

This invention will be better understood by referring to the accompanying drawings, wherein:

FIG. 13 is a perspective view of the first embodiment of a tool combining rod in the present invention;

FIG. 14 is an upper view of the first embodiment of a tool combining rod in the present invention;

FIG. 15 is a cross-sectional view of the line A—A in FIG. 14;

FIG. 16 is a perspective view of the second embodiment of a tool combining rod in the present invention;

FIG. 17 is an upper view of the second embodiment of a tool combining rod in the present invention;

FIG. 18 is a cross-sectional view of the line B—B in FIG. 17;

DETAILED DESCRIPTION OF THE PREFERRED EMBODIMENT

Figure 9:
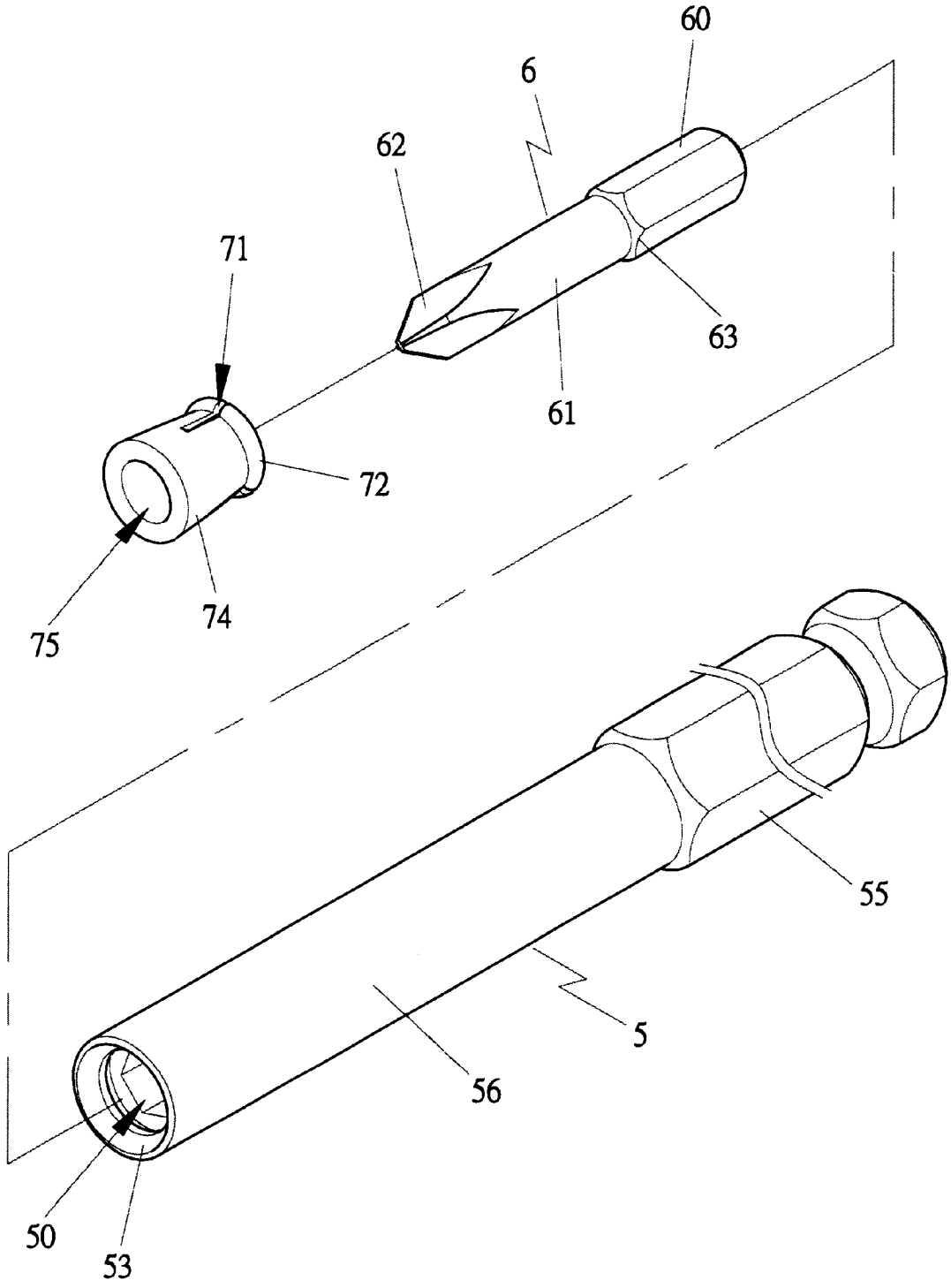
FIG. 9 is an exploded perspective view of a first embodiment of a tool combining rod in the present invention.
Figure 10:
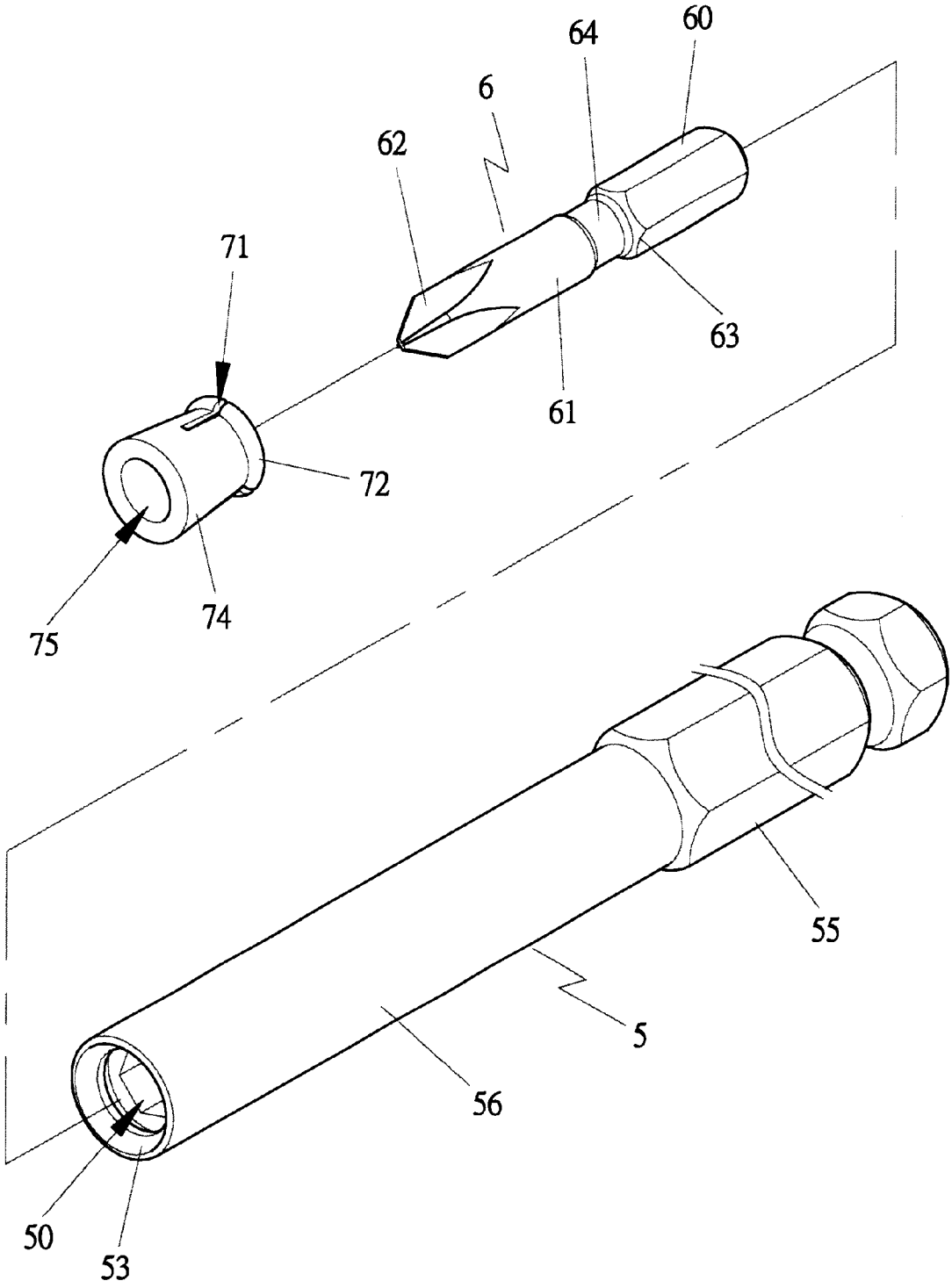
FIG. 10 is an exploded perspective view of a second embodiment of a tool combining rod in the present invention.
Figure 11:
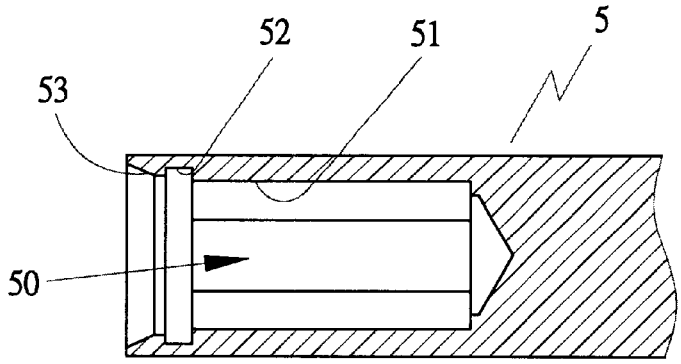
FIG. 11 is a partial cross-sectional view of the rod member of the tool combining rod in the present invention.
Figure 12:
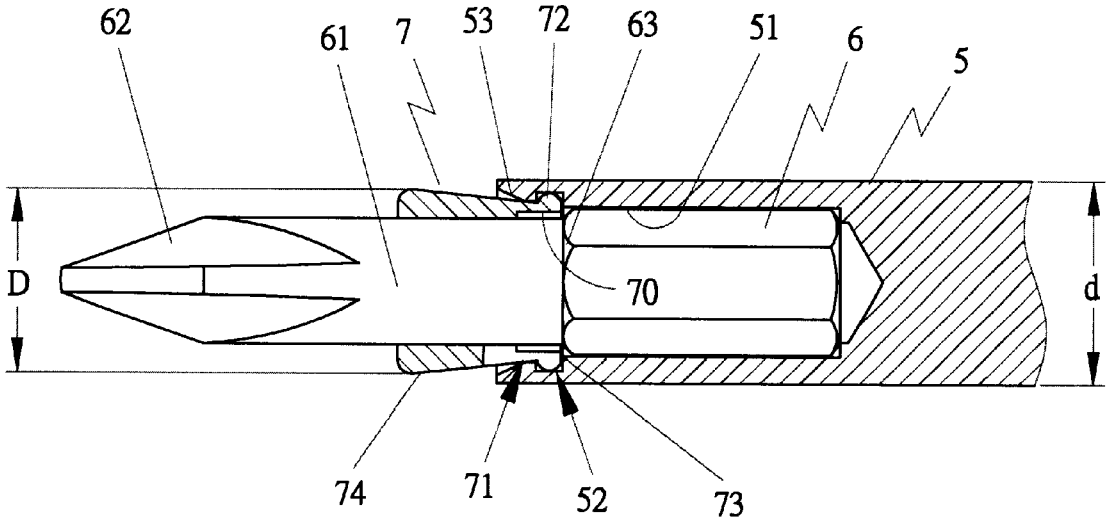
FIG. 12 is a partial cross-sectional view of the rod member combined with an engaging head member in the present invention.

A preferred embodiment of a tool combining rod in the present invention, as shown in FIGS. 9, 10 and 12, includes a rod member 5, an engaging head member 6 and an engage member 7 as main components combined together.

The rod member 5 has a front hollow 50 formed in a front end 5 and shaped as the shape of a rod portion 60 of the engaging head member 6 and having an annular groove 52 in the inner circumference 51 of the front hollow 50. The front hollow 50 has an annular tapered surface 53. A non-circular equiangular portion 55 formed in a rear part and the outer diameter of the non-circular equiangular portion 55 are larger than that of the outer surface 56 of the rod member 5.

The engaging head member 6 has a rear rod portion 60 of a geometrical shape, the rear rod portion 60 with no grooves or recesses and fitting in the rod member 5, the front rod portion 61 has an engage portion 62 formed in a front end part, with the outer diameter of the rear rod portion 60 is larger than the front rod portion 61 to define a conical portion 63 there between.

Figure 1:
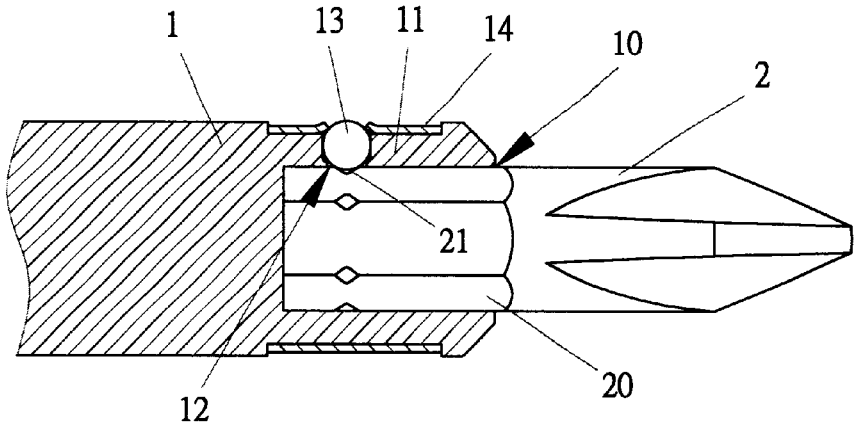
FIG 1 (PRIOR ART)
FIG. 1 is a cross-sectional view of a first kind of conventional tool combining rod.
Figure 2:
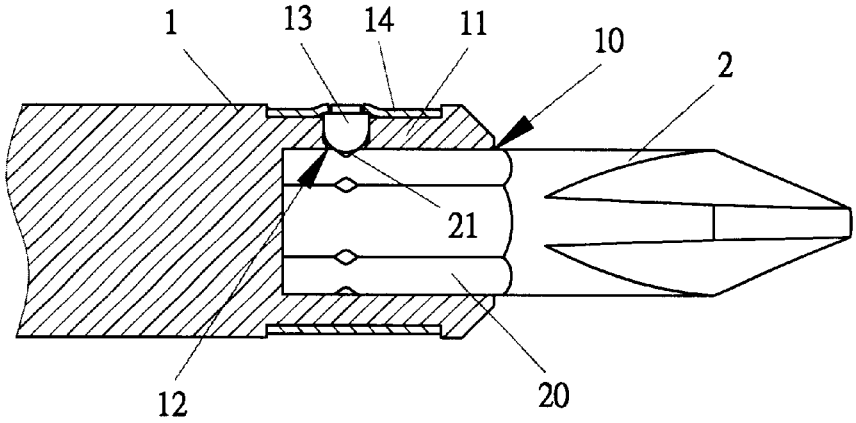
FIG 2 (PRIOR ART)
FIG. 2 is a cross-sectional view of a second kind of conventional tool combining rod.
Figure 3:
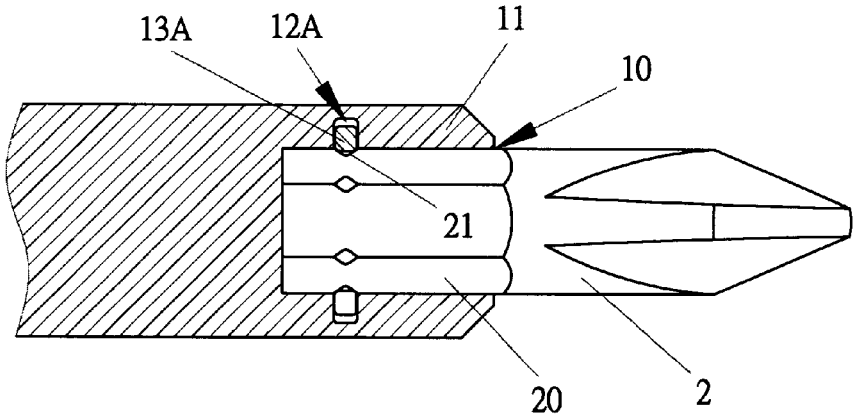
FIG 3 (PRIOR ART)
FIG. 3 is a cross-sectional view of a third kind of conventional tool combining rod.
Figure 4:
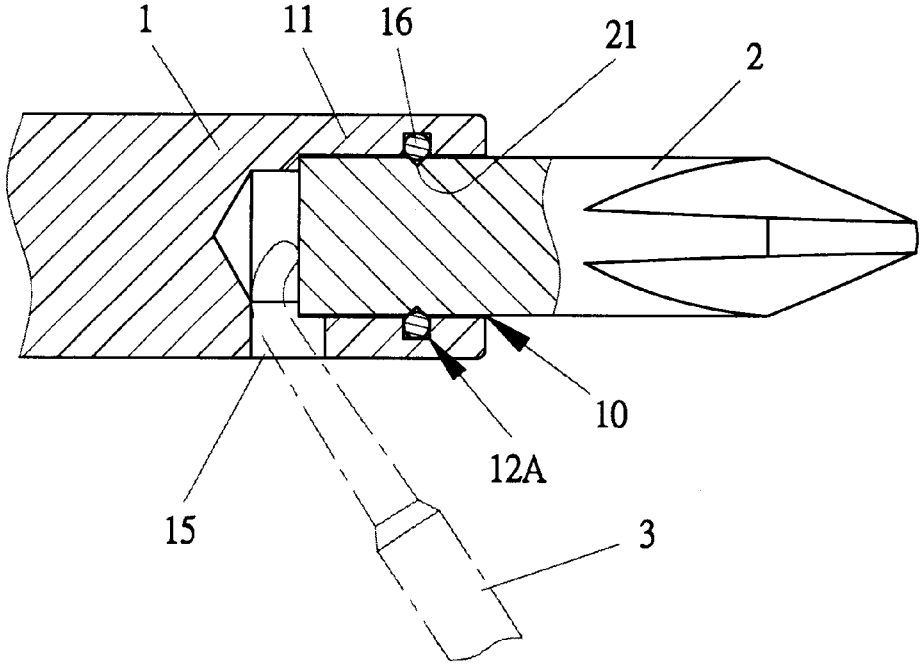
FIG 4 (PRIOR ART)
FIG. 4 is a cross-sectional view of a fourth kind of conventional tool combining rod.
Figure 5:
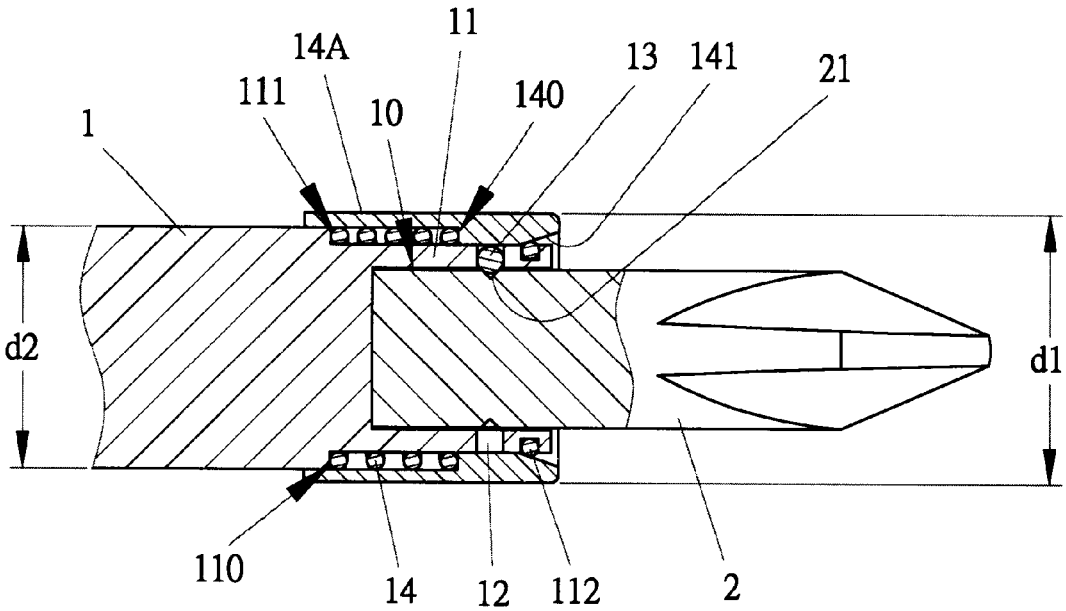
FIG 5 (PRIOR ART)
FIG. 5 is a cross-sectional view of a fifth kind of conventional tool combining rod.
Figure 6:
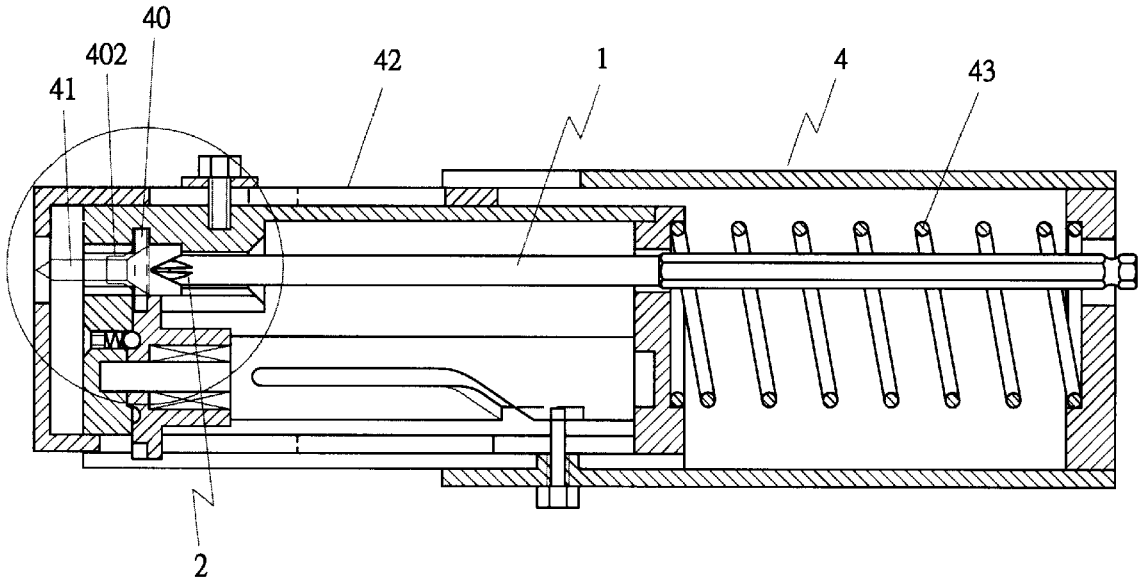
FIG 6 (PRIOR ART)
FIG. 6 is a cross-sectional view of a sixth kind of conventional tool combining rod assembled with an automatic screwdriver.
Figure 7:
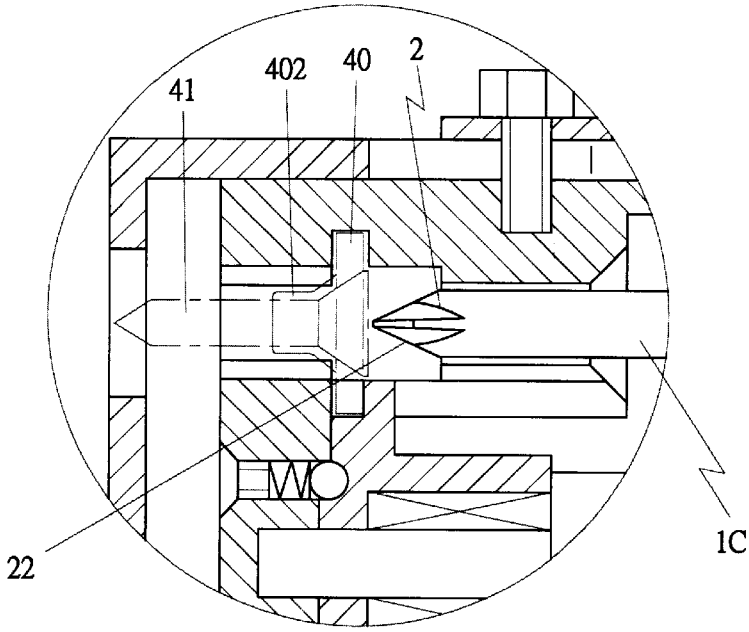
FIG 7 (PRIOR ART)
FIG. 7 is a partial magnified cross-sectional view of the sixth kind of conventional tool combining rod assembled with the automatic screwdriver.
Figure 8:
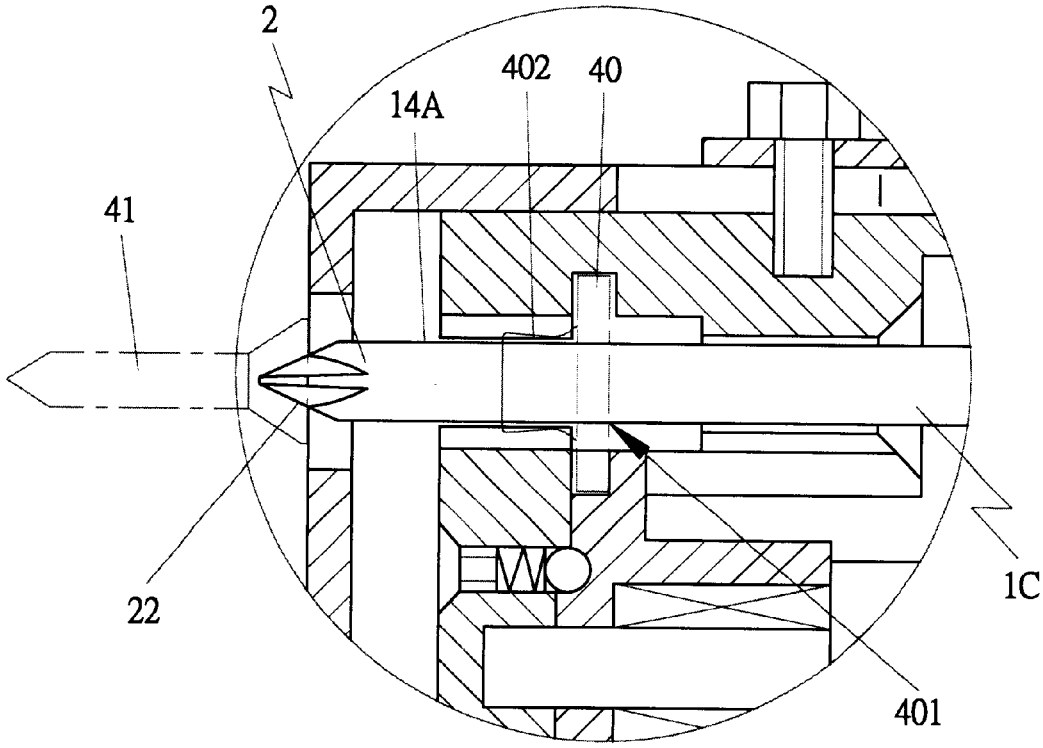
FIG 8 (PRIOR ART)
FIG. 8 is a partial magnified cross-sectional view of the sixth kind of conventional tool combining rod assembled with the automatic screwdriver in an operating condition.

The engage element 7, as shown in FIGS. 9, 10, 12–15, has a front annular wall 70A and a rear annular wall 70, and the diameter of the front annular wall 70A is larger than the rear annular wall. One or plural slots 71 equidistantly are formed in the rear annular wall 70 so as to supply the engage element 7 with necessary elasticity for engagement, and its number depends on how large the elasticity or the engaging force is needed. Further a rear flange 72 is formed at the rear end of the elastic rear annular wall 70 to engage with the annular groove 52 of the rod member 5, as shown in FIG. 12. Moreover, the engage member 7 has a rear end surface 73 tightly fitting with the conical portion 63 of the engaging head member 6, so when a user operates an automatic screwdriver 4, a screw 41 may produce outward-pulling force against the engaging head member 6 to prevent the engaging head member 6 from loosening due to the tight combination of the engaging portion 62 with the fitting groove 410 of the screw 41 during returning process of the automatic screwdriver 4. Further, the engage member 7 has a center hole 75 and an outer annular surface 74 of any shape so as to be easily clamped by an auxiliary tool 76. And the outer annular surface 74 preferably has a conical shape as shown in FIGS. 13–15, but can have any shape so long as it cannot stick with a holding periphery 402 of a screw hole 401 of a screw band 40 (see FIG. 6). Then the engage member 7 may be easily separated from the engaging head member 6 with only a little force.

Figure 19:
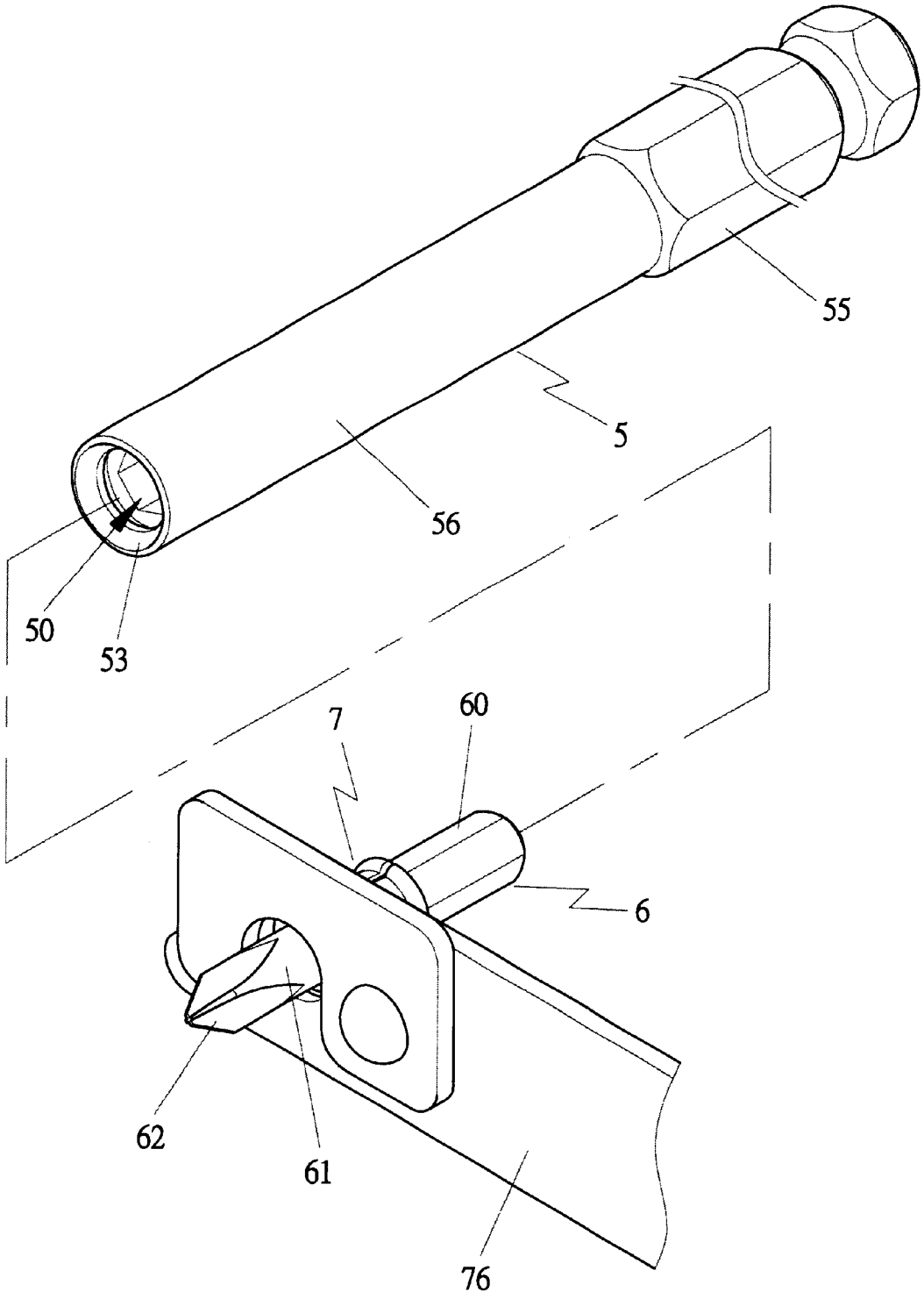
FIG. 19 is a perspective view of the tool combining rod in the present invention with an engage member not yet combined the rod member by means of an auxiliary tool.
Figure 20:
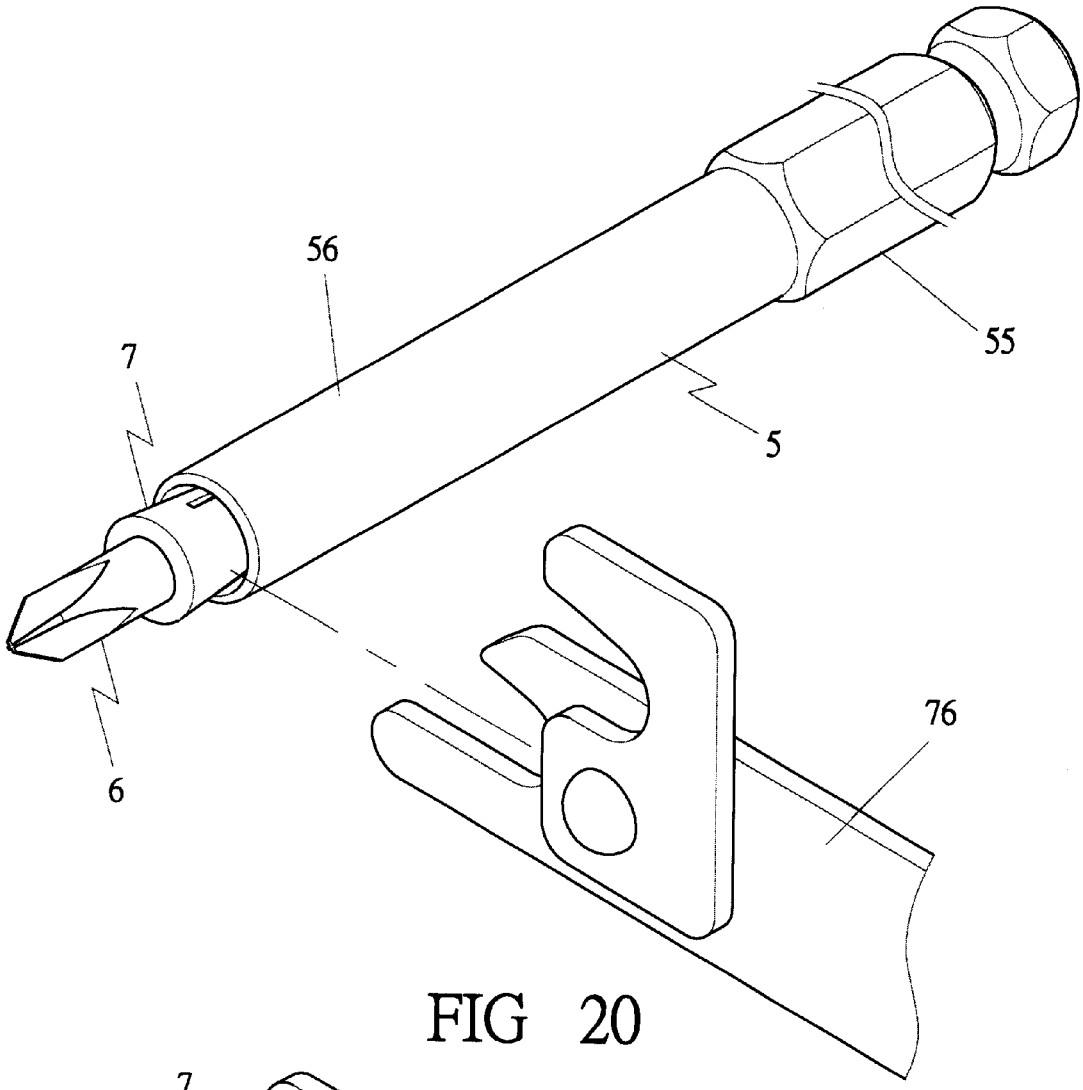
FIG. 20 is a perspective view of the tool combining rod in the present invention combined with an auxiliary too separating the engage member from the rod member.
Figure 21:
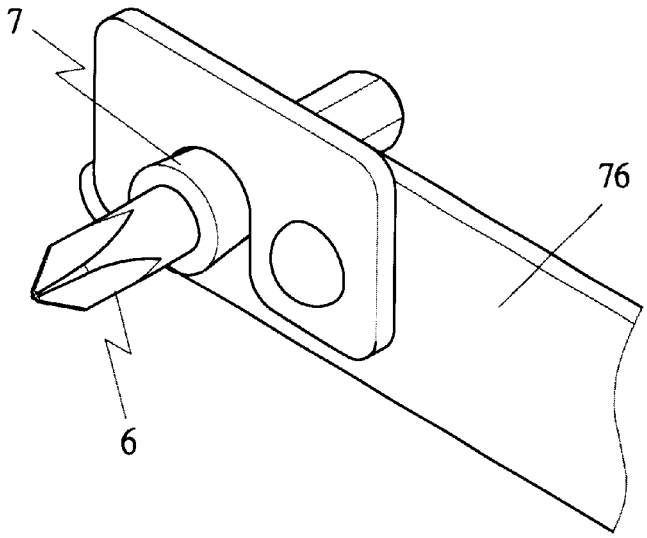
FIG. 21 is another perspective view of the tool combining rod in the present invention with the auxiliary tool separating the engage member from the rod member.

If the engaging head member 6 is to be altered, it is firstly combined with the engage member 7, as shown in FIG. 19, and then the engaging head member 6 and the engage member 7 all together are manually or by means of an auxiliary tool 76 combined with the combining hollow 50 of the rod member 5 by means of clamping and pressing the engage member 7. On the contrary, if the engaging head member 6 is to be taken out, only engage an auxiliary tool 76 with the outer periphery 74 of the engage member 7 and pull out the engaging head member 6 out of the rod member 5, as shown in FIGS. 20 and 21.

As can be seen, the tool combining rod in the present invention consists of three components, the rod member 5, the engaging head member 6 and the engage member 7. In order to adapt an automatic screwdriver 4 with the tool combining rod in the invention, the rod member 5 has the non-circular equiangular portion 55, and the substantial front portion 56 formed circular or any other shape and having a diameter smaller than or equal to the outer diameter of the rear equiangular portion 55, with the largest diameter of the engage member 72 being equal to or smaller than that of the rod member 5 for convenience of handling the automatic screwdriver 4.

Figure 22:
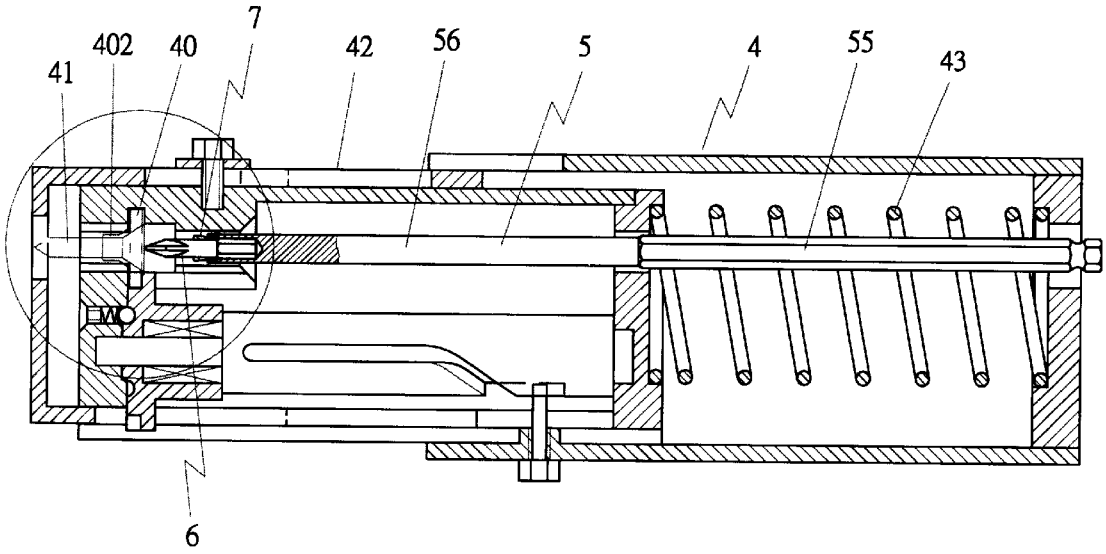
FIG. 22 is a cross-sectional view of a tool combining rod in the present invention combined with an automatic screwdriver.
Figure 23:
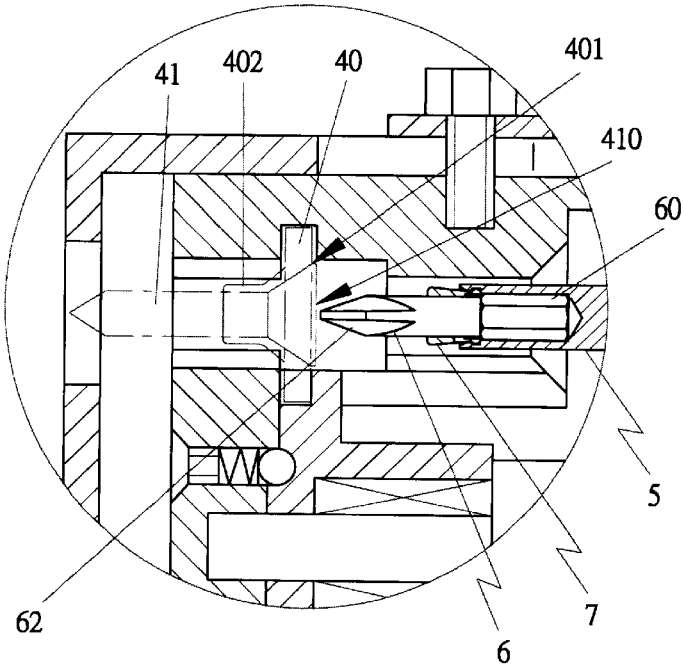
FIG. 23 is a partial magnified cross-sectional view of the tool combining rod in the present invention combined with the automatic screwdriver; and, FIG. 24 is a partial magnified cross-sectional view of the tool combining rod in the present invention in combining movement with an automatic screwdriver.
Figure 24:
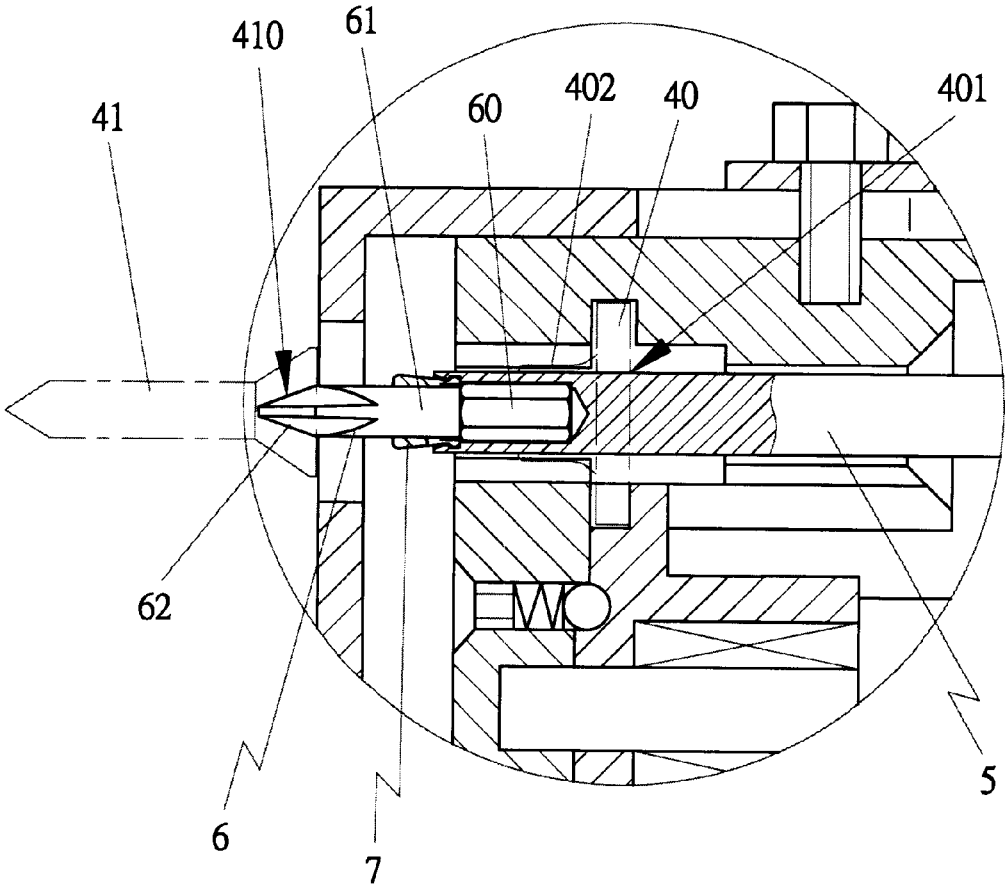

Next, shown in FIGS. 22, 23 and 24, the outer diameter of the engage member 7 is smaller than the largest outer diameter of the rod member 5, so the tool combining rod can easily move a screw 41 through the screw hole 401 of the screw band 40, as shown in FIGS. 22 and 23. After the screw 41 is driven tightly in an object, the tool combining rod is moved back by the spring 43 (practically a movable member 42 returns to its original position). At this time, the tool combining rod can move back to its original position through the screw hole 400 of the screw band 40, without a problem of being constricted dead, impossible to move. Accordingly, a user may use an automatic screwdriver 4 with the tool combining rod for driving a screw 41 smoothly and conveniently. So the tool combining rod may be manufactured with a low cost, not wearing off, splitting or tearing, needless to replace, only with the engaging head member 6 having to be replaced with a new one in case of the engage portion 62 worn off.

While the preferred embodiment has been described above, it will be recognized and understood that various modifications may be made therein and the appended claims are intended to cover all such modifications that may fall within the spirit and scope of the invention.

What is claimed is:

1. A tool combining rod comprising:

a rod member having a front hollow formed in a front end, an annular tapered surface of said front hollow having an annular groove in the inner circumference of said front hollow, a non-circular equiangular portion, and the outer diameter of the non-circular equiangular portion being larger that that of the outer surface of the rod member:

an engaging head member having a rear rod portion of a geometrical shape, and a front rod portion provided with an engage portion, with the outer diameter of the rear rod portion being larger that of the front rod portion to define conical portion:

an engage element having a front annular wall and a rear annular wall, the diameter of said front annular wall being larger than that of said rear annular wall, a slot equidistantly formed in the rear annular wall; a rear flange formed at the rear end of the elastic rear annular wall to engage with said annular groove of said rod member; a rear end surface tightly fitting with the conical portion of said engaging head member; a center hole and an outer annular surface.

2. The tool combining rod as claimed in claim 1, wherein said rod member has a front hollow, which is shaped circular or non-circular.

3. The tool combining rod as claimed in claim 1, wherein said engaging head member has a rear rod portion and a front rod portion, an engage portion formed in said rod portion, said front rod portion having a recessed annular groove.

4. The tool combining rod as claimed in claim 1, wherein said engage member an has annular wall and a center hole, said annular wall having a plurality of slots, and a flange formed in a rear end, said engage head member firstly combined with said engage member and then said engage head member together with said engage member all combined in said front combining hollow of said rod member.

5. The tool combining rod as claimed in claim 4, wherein said annular wall of said engage member has one slot provided in its annular wall.

6. The tool combining rod as claimed in claim 4, wherein said annular wall of said engage member has a plurality of slots in its annular wall.

* * * * *